US006349182B2

(12) United States Patent
Otsubo et al.

(10) Patent No.: US 6,349,182 B2
(45) **Date of Patent: *Feb. 19, 2002**

(54) CONNECTOR UNIT, PROCESS CARTRIDGE AND ELECTROPHOTOGRAPHIC IMAGE FORMING APPARATUS

(75) Inventors: Toshihiko Otsubo, Numazu; Michio Kawase, Mishima; Kazuyoshi Suzuki, Numazu; Takahiro Watanabe, Shizuoka-ken; Jun Yamaguchi, Numazu; Tetsuro Fukusaka, Susono, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/182,454

(22) Filed: Oct. 30, 1998

(30) Foreign Application Priority Data

Oct. 31, 1997 (JP) ..... 9-316243
Oct. 26, 1998 (JP) ..... 10-321330

(51) Int. Cl.[7] ..... G03L 15/00
(52) U.S. Cl. ..... 399/12; 399/90; 399/111
(58) Field of Search ..... 399/90, 111, 112, 399/12, 24–27; 361/736, 786; 439/55, 68, 76.1, 620

(56) References Cited

U.S. PATENT DOCUMENTS 4,826,332 A * 5/1989 Ukai et al. ..... 400/70
4,839,691 A * 6/1989 Tagawa et al. ..... 399/12
4,961,088 A * 10/1990 Gilliland et al. ..... 399/25
5,014,094 A * 5/1991 Amitani et al. ..... 399/12
5,276,461 A * 1/1994 Saito ..... 347/129
5,415,556 A * 5/1995 Schroll ..... 439/77
5,491,540 A * 2/1996 Hirst ..... 399/12
5,907,748 A * 5/1999 Kawana ..... 399/111

FOREIGN PATENT DOCUMENTS

| | | | |
|---|---|---|---|
| EP | 789322 | * | 8/1997 |
| EP | 0 789 322 A2 | | 8/1997 |
| EP | 802461 | * | 10/1997 |
| EP | 0 802 461 A2 | | 10/1997 |
| JP | 1-221765 | * | 9/1989 |
| JP | 8-297454 | * | 11/1996 |
| JP | 9-213407 | * | 8/1997 |

* cited by examiner

*Primary Examiner*—Joan Pendegrass
(74) *Attorney, Agent, or Firm*—Fitzpatrick, Cella, Harper & Scinto

(57) ABSTRACT

A unit connector for electrical connection with a main assembly connector provided in a main assembly of an electrophotographic image forming apparatus, includes memory for storing information; a memory connecting portion for electrical connection with said memory when said unit connector is mounted to a unit; an electrical part connecting portion for electrical connection with an electrical part of the unit when said unit connector is mounted to the unit; and a connector connecting portion for electrical connection with the main assembly connector of said apparatus.

28 Claims, 10 Drawing Sheets

CONNECTOR UNIT, PROCESS CARTRIDGE AND ELECTROPHOTOGRAPHIC IMAGE FORMING APPARATUS

FIELD OF THE INVENTION AND RELATED ART

The present invention relates to a connector for electrical connection, a unit provided with the connector, a process cartridge provided with the connector, and an electrophotographic image forming apparatus to which a process cartridge is detachably mountable.

Here, the term "electrophotographic image forming apparatus" refers to an apparatus for forming an image on a recording material used in an electrophotographic image forming process. It includes an electrophotographic copying machine, an electrophotographic printer (for example, a LED printer, a laser beam printer or the like), an electrophotographic printer type facsimile machine and an electrophotographic printer type word processor or the like.

The process cartridge contains, integrally, an electrophotographic photosensitive member and charging means, and developing means or cleaning means, and is detachably mountable relative to a main assembly of the image forming apparatus. An electrophotographic photosensitive member and at least one of a charging means, a developing means and a cleaning means may be in the form of a cartridge containing them integrally, wherein the cartridge is detachably mountable relative to a main assembly of the electrophotographic image forming apparatus. The process cartridge may be in the form of a cartridge containing at least developing means and an electrophotographic photosensitive member as a unit, which is detachably mountable relative to the main assembly of the electrophotographic image forming apparatus.

The unit may be a developing cartridge, a fixing unit or an intermediary transfer unit, which is detachably mountable relative to the main assembly of the electrophotographic image forming apparatus.

In an electrophotographic image forming apparatus using an electrophotographic image forming process, the process cartridge is used, which contains the electrophotographic photosensitive member and process means actable on the electrophotographic photosensitive member, and which is detachably mountable as a unit to a main assembly of the image forming apparatus (process cartridge type). With this process cartridge type, the maintenance of the apparatus can be carried out, in effect, by the user without depending on a serviceman. Therefore, the process cartridge is now widely used in electrophotographic image forming apparatuses.

In order to further improve the usability of the process cartridge with an electrophotographic image forming apparatus the provision of the following functions are considered.

(1) The first function is to provide the process cartridge with an electronic device, such as a memory, storing data such as the manufacturing conditions, when the process cartridge or the like is manufactured or shipped from the plant. The data is discriminated by the main assembly of the image forming apparatus when the process cartridge is mounted to the main assembly of the image forming apparatus. An image forming operation is then carried out under the optimum conditions of the process cartridge on the basis of the result of the discrimination.

(2) The second function is to detect the amount of life left in the photosensitive drum during the image forming operation. The data is held in the memory. By doing so, the lifetime of the photosensitive drum can be referred to at proper stages.

(3) The third function is to provide diagnosis data of the main assembly of the image forming apparatus held in the memory of the process cartridge. Upon the occurrence of an abnormality or upon the performing of a maintenance operation, the service person can use the data. By doing so, a quick servicing operation is possible.

When these functions are added to the image forming apparatus, the process cartridge is required to be provided with an electronic device, such as an EEPROM for example. When the electronic device is used, an electronic device, such as memory and a connector, are provided on the printed board. The printed board is considered to be mounted on the process cartridge.

When the electrical parts are mounted in the process cartridge, it is generally considered that electronic parts and function parts, such as IC devices such as a non-volatile memory, a diode for protecting the IC from an external surge pulse, a resistance element, a capacitor, a connector or the like, are mounted on the printed board.

The present invention further improves on the prior art in this respect.

SUMMARY OF THE INVENTION

Accordingly, it is a principal object of the present invention to provide a connector provided with the memory, a unit and a process cartridge provided with the connector, and an elecctrophotographic image forming apparatus.

It is another object of the present invention to provide a connector provided with the memory, a unit and a process cartridge provided with the connector, and an electrophotographic image forming apparatus, wherein an electric connection is established between the connector and the main assembly of the apparatus.

It is a further object of the present invention to provide a small-size connector provided with the memory, a unit and a process cartridge provided with the connector, and an electrophotographic image forming apparatus.

According to an aspect of the present invention, there is provided a unit connector for electrical connection with a main assembly connector provided in a main assembly of an electrophotographic image forming apparatus, the unit connector comprising a memory for storing information; a memory connecting portion for electrical connection with the memory when the unit connector is mounted to a unit; an electrical part connecting portion for electrical connection with an electrical part of the unit when the unit connector is mounted to the unit; and a connector connecting portion for electrical connection with the main assembly connector of the apparatus.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 1(*b*) is a side view of the connector in the process cartridge: FIG. 1(*c*) is a side view of a connector provided in a main assembly of the apparatus: and FIG. 1(*d*) is a bottom view of the connector provided in the main assembly.

FIG. 8(*b*) is a left side view thereof: FIG. 8(*c*) is a front view thereof: and FIG. 8(*d*) is a top plan view as seen from the opposite side.

DESCRIPTION OF THE PREFERRED EMBODIMENTS

Referring to the accompanying drawings, the embodiments of the present invention will be described.

Figure 1A:
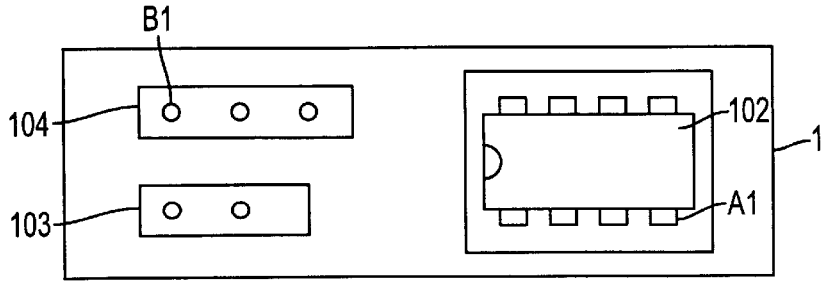
FIG. 1(*a*) is a top plan view of a connector provided in a process cartridge.
Figure 1B:
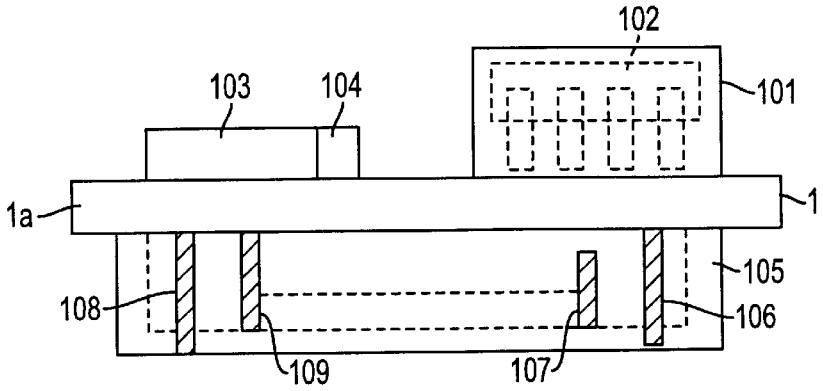
Figure 1C:
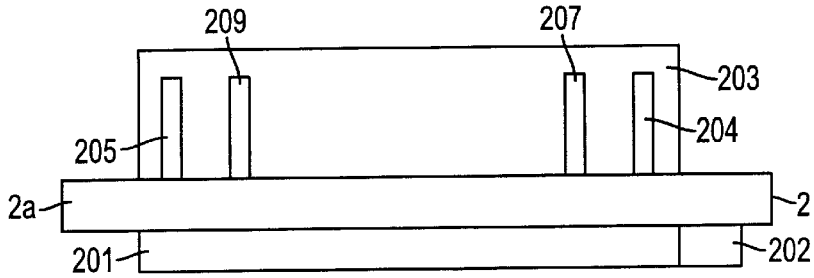
Figure 1D:
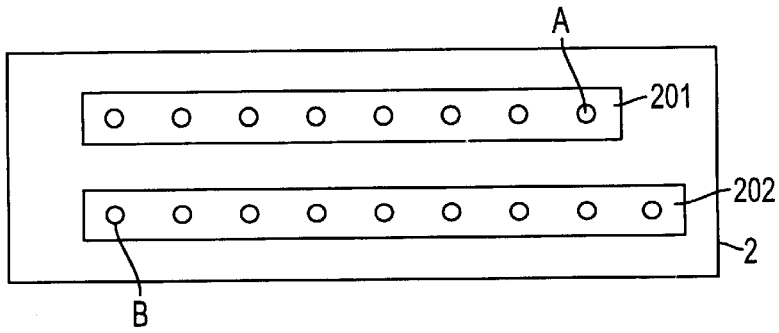
Figure 2:
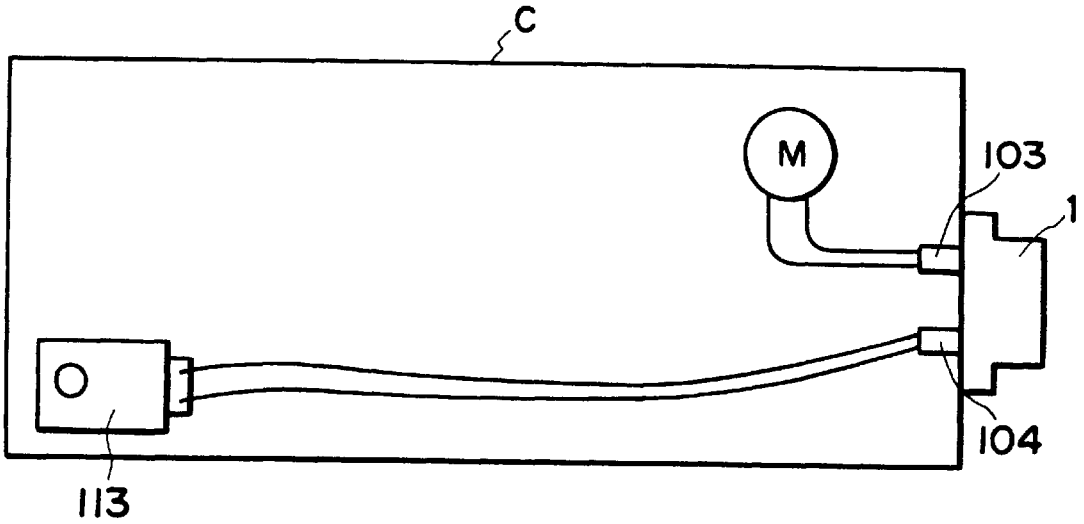
FIG. 2 is a schematic view showing arrangements of the sensor or the like in the process cartridge.
Figure 3:
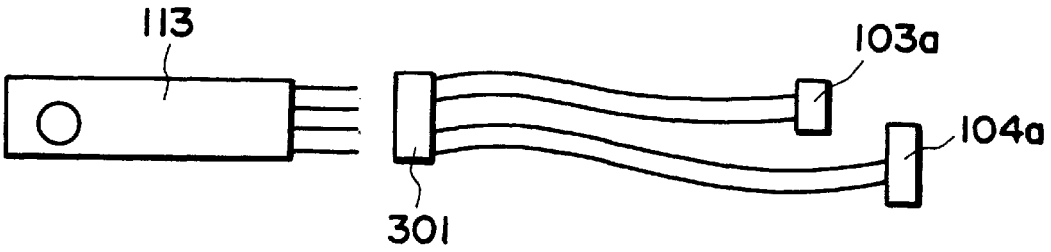
FIG. 3 is a side view of a bundle of leads.

FIGS. 1, 2 and 3 show an embodiment of the present invention. FIG. 1 and FIG. 2 show a connector according to an embodiment of the present invention. In the figures, a connector 1 is mounted in the process cartridge 31. A connector 2 of the main assembly of the apparatus is mounted in a main assembly 16 of the apparatus to which the process cartridge 31 is mounted.

One end of the connector 1 is provided with a socket 105 engageable with a plug 203 of the connector 2. The other side is provided with a mounting portion 101 for IC and with connectors 103, 104, and between the one end and the other end, there is a flange 1*a* functioning as mounting means for the connector 1.

One end of the connector 2 is provided with a plug 203 engageable with the socket 105. The other end is provided with connectors 201, 202, and between the one end and the other end, there is a flange 2*a* functioning as mounting means for the connector 2. The connectors 201 and 202 function to connect with a controller in the main assembly 16 of the apparatus.

The connector 1 will be first disclosed. Designated by 101 is a mounting portion for the IC. The IC mounting portion 101 is provided in the connector 1 to mount the IC102 on the process cartridge 31. In the present embodiment, the IC mounting portion 101 is provided with an IC102 having 8 pins. The IC102 is an EEPROM.

A GND contact of the IC102 is disposed at a position A1 shown in FIG. 1(*a*). Designated by 103 and 104 are additional connectors. The additional connectors 103, 104 are for electric connection with a voltage source for a sensor, a control portion and a detection portion (in this example, the sensor will be taken for explanation, but, as shown in FIG. 2, the sensor 113 and the motor M may be connected with the additional connectors 103, 104). The sensor 113 in the present embodiment is to detect the toner content in a developing device for the purpose of maintaining a constant toner content in the developing device of the process cartridge 31. The sensor 113 receives a voltage Vcont for the sensor 113, the voltage source (GND and Vcc) and a corrected lamp voltage output Vout from the sensor 113. To the additional connectors 103, 104, connectors 103*a* and 104*a* (FIG. 3) are connected. Furthermore, connector 301 and sensor 113 are connected. The connector 301 and the connectors 103*a*, 104*a* are connected through leads. A contact portion B1 of the connector 104 is connected with a contact portion B (GND). This is effected by contact of the contact 108 connected with the contact portion B1 and a contact 205 connected with the main assembly side contact portion B. The contact 106 is longer than the contact 107 connected with the other contacts of the IC102 and than the contact 109 of the connector 103. The contact 106 is connected with the GND contact A1 of the IC102. the contact 108 has the same length as the contact 106 connected with the contact A1 of the IC102. The contact 108 is connected with the contact portion B1 for grounding the sensor 113. The contacts 106–109 are enclosed by the socket 105. The socket 105 and a plug 203 having contacts 204, 205, 207, 209 are engaged. When the process cartridge 31 is mounted to the main assembly 16 of the apparatus, the contact 106 and the contact 108 are first connected with the contacts 204 and 205 of the connector 2, respectively. Only then, the other contacts 107, 109 are connected with the contacts 207, 209 of the connector 2.

A description will be provided as to the main assembly 16 of the apparatus. The connector 2 is wired by two lines of connectors of the connectors of the connectors 201, 202. The lengths of the connector 201 and 202 are different from each other. Therefore, erroneous insertion between the connectors can be avoided. The connector 201 corresponds to the additional connector 103 and 1–4 pins of the IC102. The connector 202 corresponds to the connector 104 and 5–8 pins of the IC102. The contact portion A of the connector 201 corresponds to the contact 106 of the connector 1 (GND contact A1 of the IC102). The contact portion B of the connector 202 corresponds to the contact 108 of the connector 1 (contact portion B1 of the additional connector 104).

When the contact A1 and the contact portion B1 of the process cartridge 31 are connected with either one of the connector 210 and 202 of the connector 2, the GND level can be assured (it is a possible structure that contact A1 of the IC102 and contact B1 of the additional connector 104 are not connected with each other). When a load is connected to the additional connector 103, 104, noise may cause a malfunction of the IC102, and in such a case they are not connected.

The IC102 has memory and a CPU. The memory is an EEPROM in the embodiment.

Figure 4:
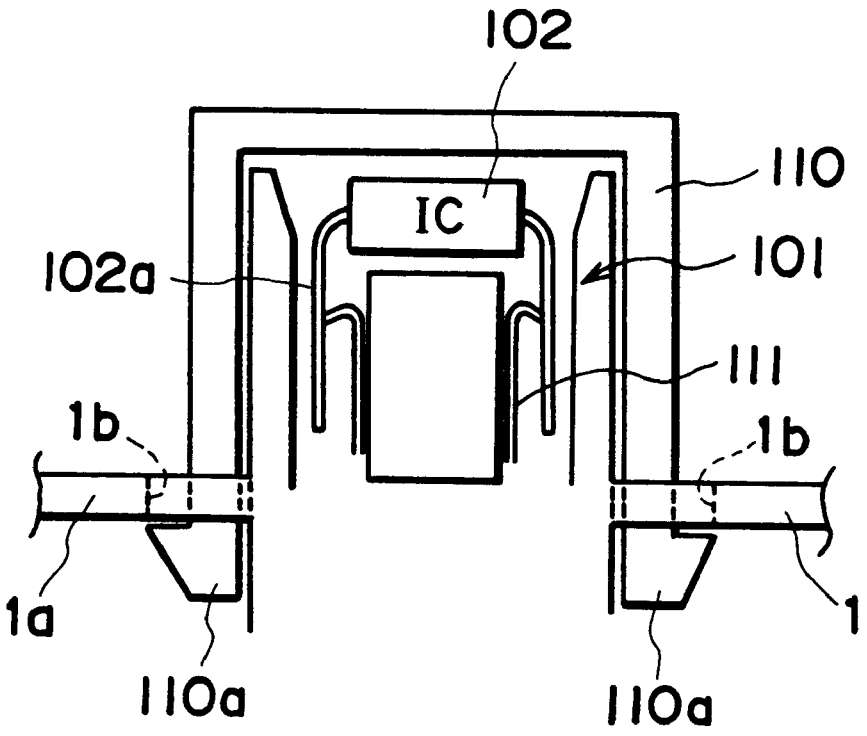
FIG. 4 is a longitudinal sectional view of a cover for IC.

As shown in FIG. 4, the pins 102*a* of the IC102 are contacted to the contact elements 111. The contact elements 111 are extended upwardly from the contacts 106, 107 of the connector 1 shown in FIG. 1(*b*).

Figure 5:
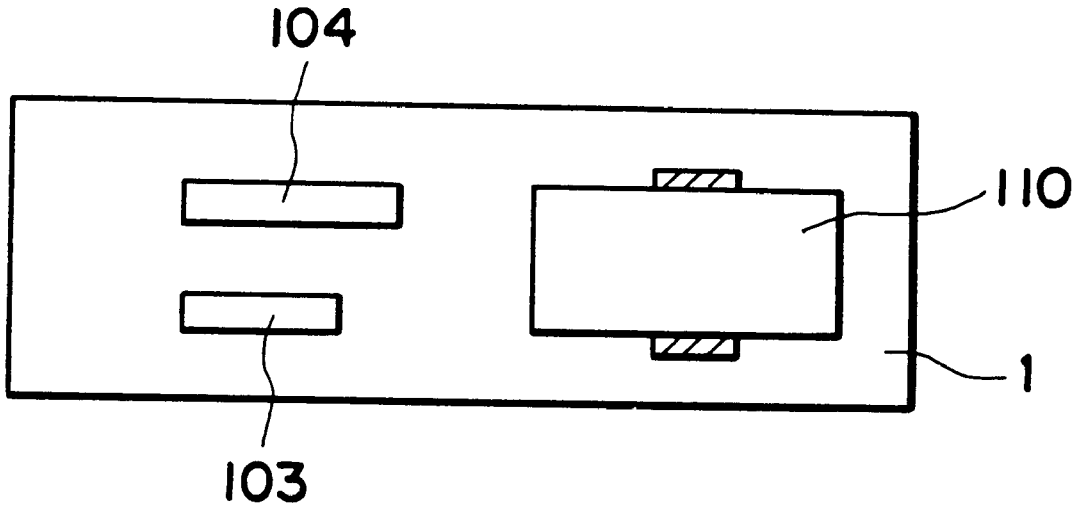
FIG. 5 is a top plan view of a connector provided in the process cartridge, when the cover is mounted.

FIGS. 4, 5 shown a cover 110 of the connector 1 for the IC. Through holes 1*b* are formed at sides of the IC mounting portion 101 of the connector 1. The IC cover 110 covers the IC102. The cover 110 is provided with projected portions 110*a* each having a claw. The projected portions 110 are inserted into the holes 1*b* of the connector 1 to mount it. Therefore, the cover 110 is demountably mounted to the connector 1. However, since the claw portions are inserted into the holes 1*b,* the cover is not easily disengaged.

The pitches of the connector 1 and the IC102 are as follows. Normally, an IC has a pitch of 2.54 mm, but the connector 2 is not limited to 2.54 mm, and may be 2 mm, 1.5 mm or the like. For example, it is possible to use different pitches of the connecting pins in the main assembly side and the process cartridge. Therefore, the pitch of 2.54 mm is not inevitable.

The connector 2 of such a structure is mounted to the main assembly 16 of the image forming apparatus. On the other hand, the connector 1 is mounted to a developing cartridge (unit), a cleaning unit, a fixing device unit, a transfer unit, and a charging unit or the like or mounted to the process cartridge. Particularly, the connector 1 is mounted to a process cartridge which contains an electrophotographic photosensitive member and process means as a unit. By doing so, it is possible for the main assembly of the apparatus to know a hysteresis of the process cartridge and states of various parts of the process cartridge.

Figure 6:
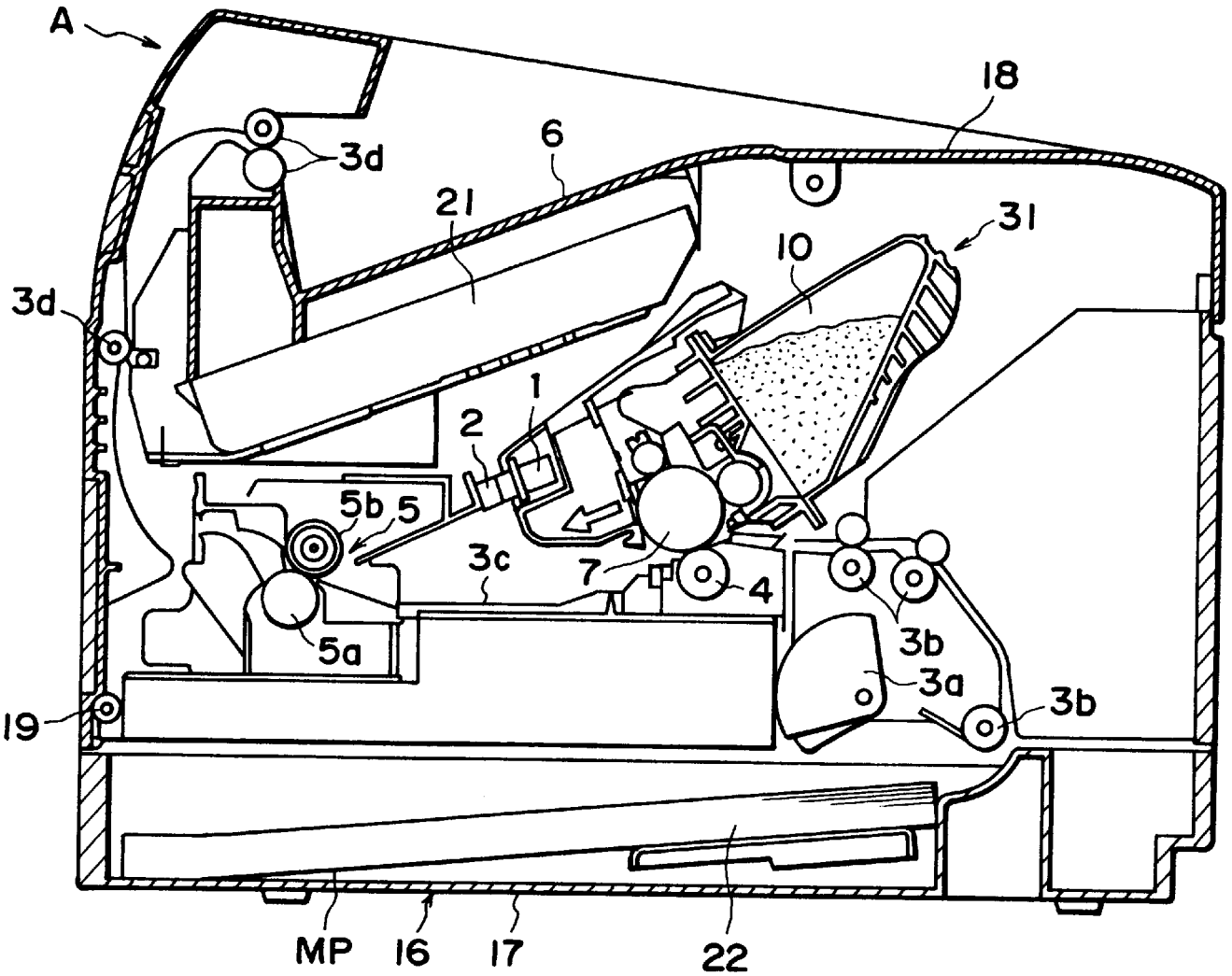
FIG. 6 is a longitudinal sectional view of an electrophotographic image forming apparatus.
Figure 7:
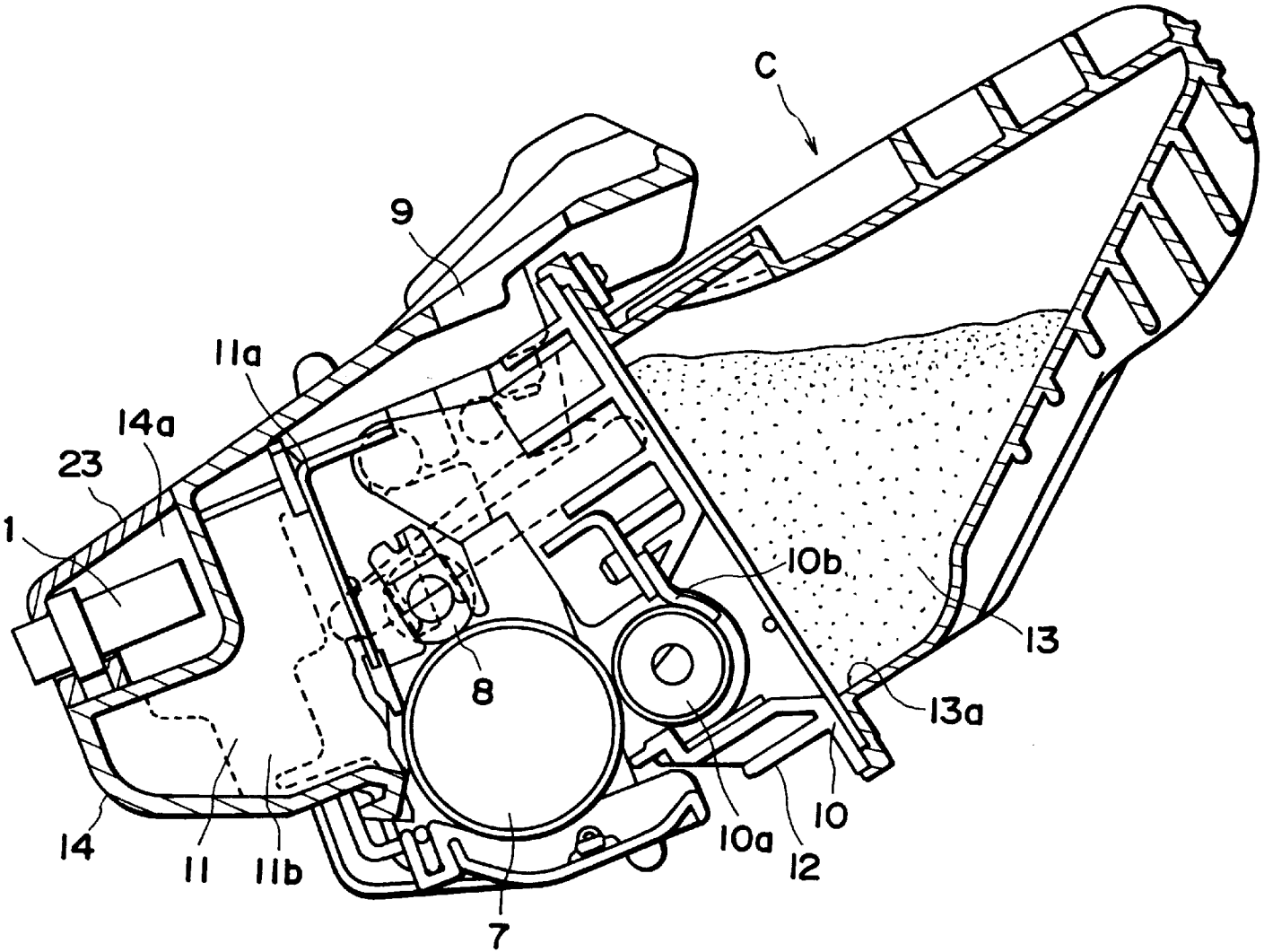
FIG. 7 is a longitudinal sectional view of a process cartridge.
Figure 8A:
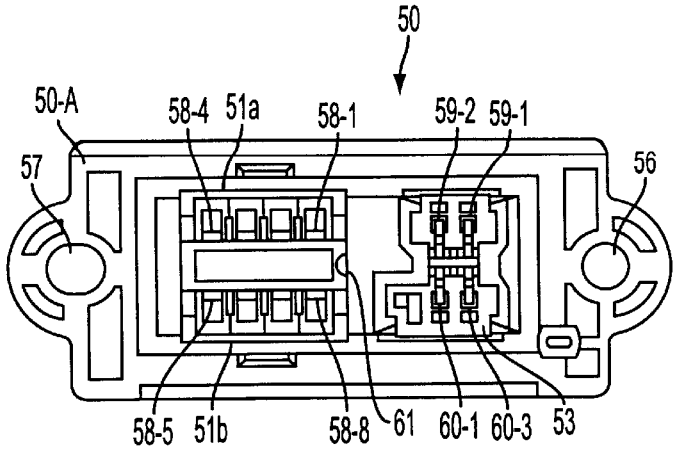
FIG. 8(*a*) is a top plan view of a connector provided in a process cartridge.
Figure 8B:
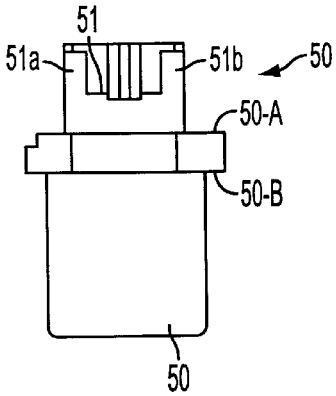
Figure 8C:
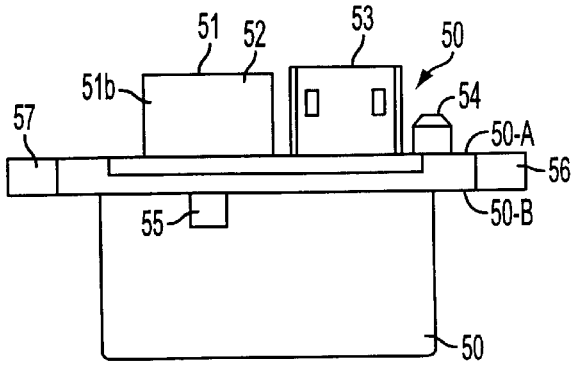
Figure 8D:
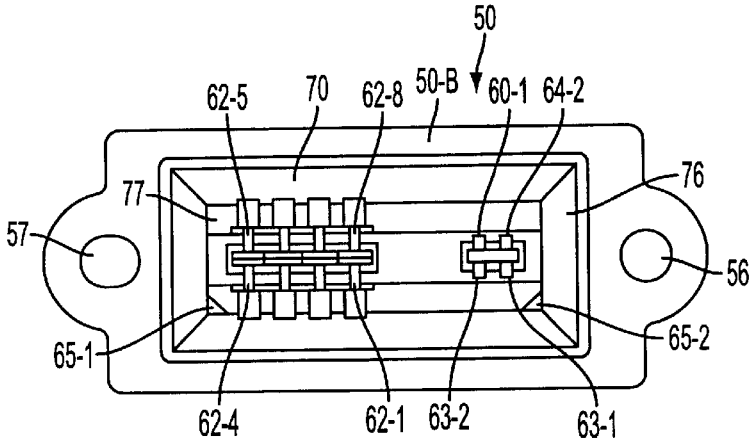
Figure 9A:
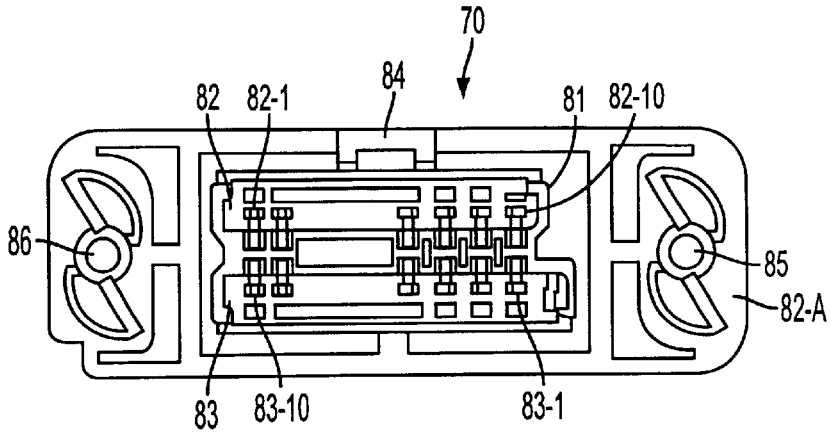
FIG. 9(*a*) is a top plan view of a connector provided in a main assembly of the apparatus, FIG. 9(*b*) is a front view thereof, FIG. 9(*c*) is a left side view thereof, and FIG. 9(*d*) is a top plan view as seen from the opposite side.
Figure 9B:
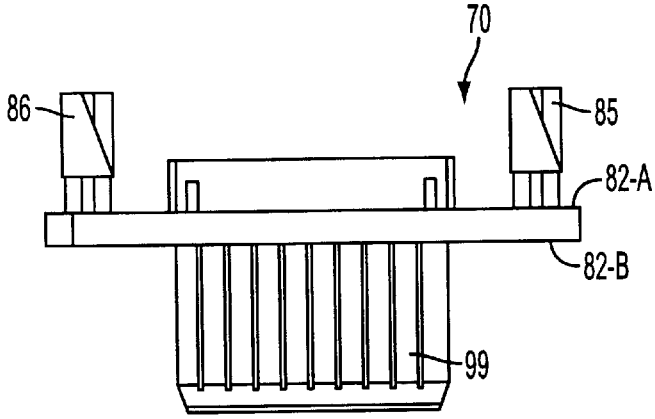
Figure 9C:
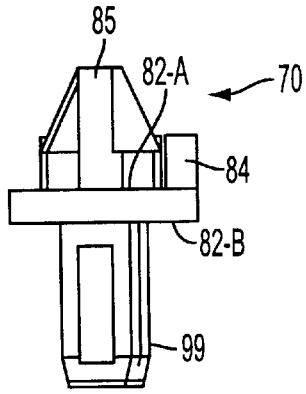
Figure 9D:
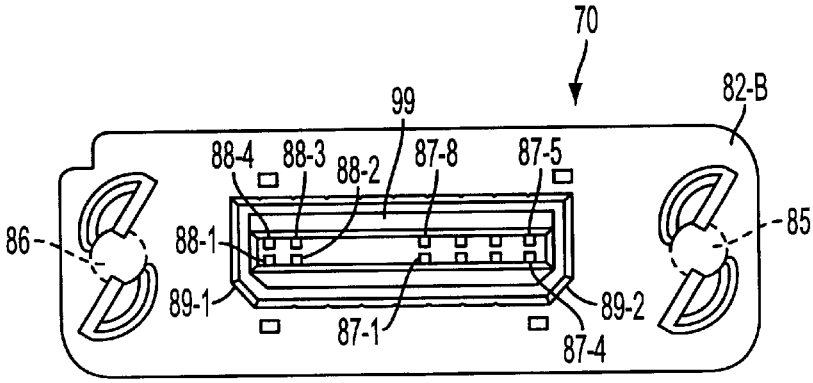

FIG. 6 is a sectional view of an electrophotographic image forming apparatus to which a process cartridge according to an embodiment of the present invention is mounted and which is a laser beam printer as an exemplary image forming apparatus. FIG. 7 is a sectional view of a process cartridge mounted in the image forming apparatus of FIG. 6.

The image forming apparatus 30 according to an embodiment of the present invention, is loaded with a process cartridge 31 as shown in FIG. 6. A laser beam modulated in accordance with the image information is projected onto the photosensitive drum 7 from an optical system 21 to form an electrostatic latent image. The electrostatic latent image is developed with a developer (toner) by developing means 10 provided in the process cartridge 31. In synchronism with formation of the toner image, the recording material 22 is fed by feeding means 3*a,* 3*b.* The toner image is transferred onto the recording material 22 by transferring means 4 from the photosensitive drum 7. Thereafter, the recording material 22, now having the toner image, is fed to the fixing means 5 by feeding means 3*c.* The toner image is fixed on the recording material 22 by a pressing roller 5*a* and a fixing roller 5*b.* Then, the recording material 22 is discharged to a discharging portion 6 by feeding means 3*d.*

The main assembly 16 of the apparatus comprises a lower frame 17 and an upper frame 18 which is openable from the lower from 17. The frames 17, 18 are hinged by a hinge 19. The lower frame 17 includes a paper magazine MP for the recording materials 22, most of the feeding means 3*a,* 3*b,* 3*c,* the transferring means 4 and the fixing means 5 or the like. The upper frame 18 includes the optical system 21 and a part of the feeding means.

In FIG. 6, the upper frame 18 is rotated in the counterclockwise direction about the hinge 19. By this, the frames 17, 18 are opened. Then, the process cartridge B is inserted along a guide portion (unshown) provided in the lower frame 17 in the direction from the upper right to the lower left in FIG. 6. Thereafter, the process cartridge 31 is positioned in place by a positioning member (unshown). Simultaneously therewith, the I/O connector 2 in the lower frame 17 and the I/O connector 1 in the process cartridge 31 are connected.

To dismount the process cartridge 31 from the main assembly 16 of the apparatus, the upper frame 18 is opened, and the process cartridge 31 is pulled up in the opposite direction, namely, from the lower left to the upper right. At this time, the I/O connector 1 and the connector 2 are disengaged from each other.

In the present embodiment, as shown in FIG. 7, the process cartridge 31 contains the photosensitive drum 7 and process means actable on it including the charging means 8 for charging the surface of the photosensitive drum 7, exposure portion 9 for projecting a light image from the optical system 21 onto the surface of the photosensitive drum 7 charged by the charging means 8, the developing means 10 and cleaning means 11 having a cleaning blade 11*a* and a toner stagnation 11*b.* The developing means 10 comprises a developer container 13 accommodating the developer and a developing frame 12 coupled with the developer container 13 at the opening 13*a* of the developer container 13. The developing device frame 12 is provided with a developing sleeve 10*a* and a toner regulating blade 10*b* contacted to the developing sleeve 10*a.*

After the toner image is transferred onto the recording material 22 by the transferring means (charging roller) 4, the photosensitive drum 7 contained in the process cartridge 31 is cleaned by the cleaning blade 11*a* so that developer, remaining on the photosensitive drum 7, is removed.

As described hereinbefore, by mounting the process cartridge 31 to the main assembly 16 of the apparatus, the connector 1 and the connector 2 are connected with each other. The IC102 is then supplied with a voltage Vcc and is enabled. The memory in the IC102 communicates with an engine controller (unshown) in the main assembly 16 of the apparatus under the control of the CPU in the IC102. The engine controller in the main assembly 16 of the apparatus, is supplied with the information on the process cartridge B, such as the presence or absence of the cartridge, the hysteresis of the process cartridge B, the current temperature, the charger resistance, the toner remainder, the toner content or the like. The information to be supplied to the engine controller is not limited to the above-described one, but may be selected or added properly by the one skilled in the art.

(Embodiments)

FIGS. 8–11 shows another embodiment.

Figure 12:
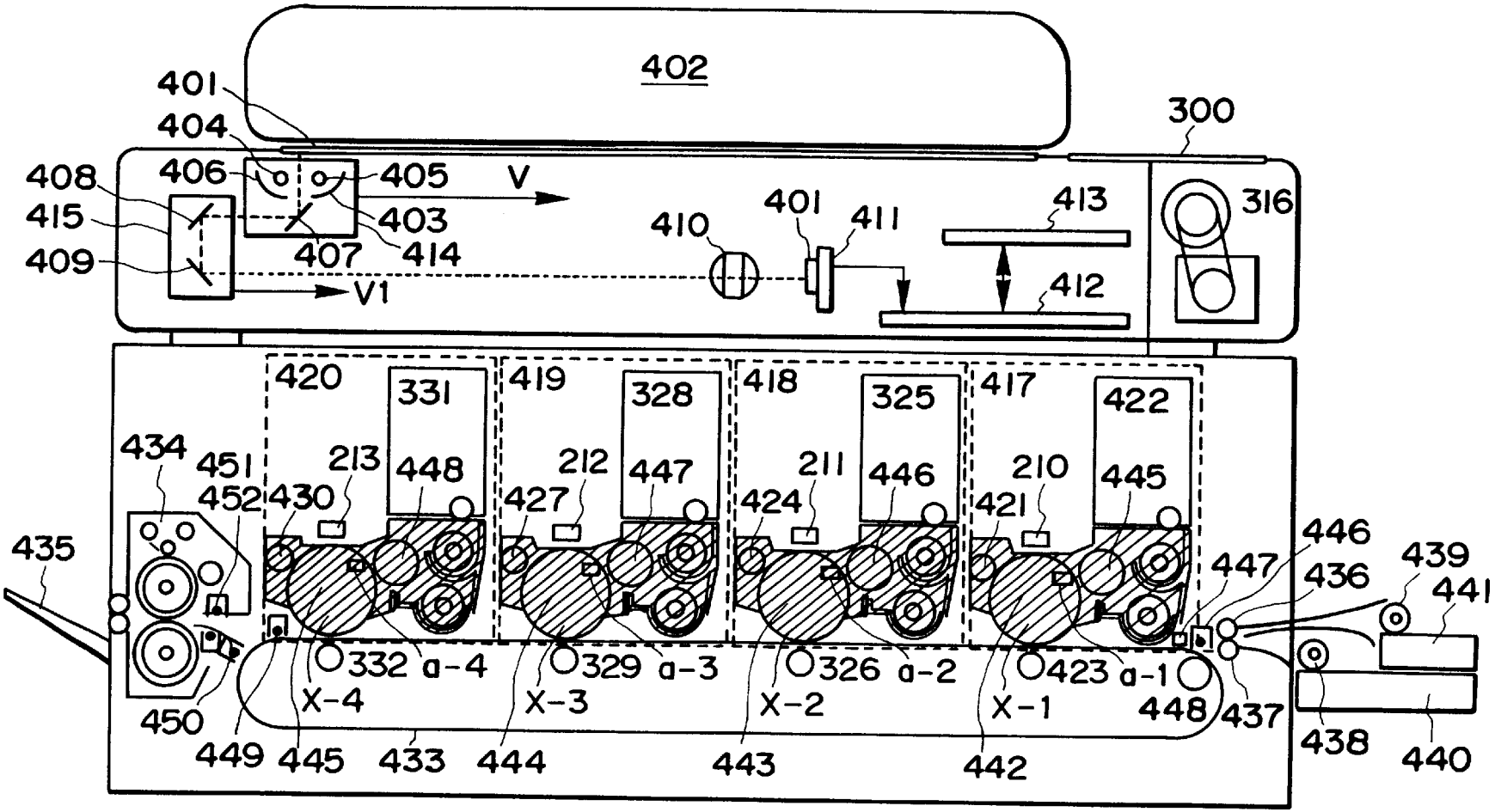
FIG. 12 is cross-sectional view of a fall-color electrophotographic copying machine.

FIG. 12 shows a general arrangement of a color image forming apparatus.

A description will first be provided as to a color reader portion.

In FIG. 12, designated by 401 is a CCD; 411 is a substrate on which the CCD101 is mounted; 412 is a printer process portion; 401 is an original carriage glass (platen); 402 is an original feeding apparatus (in place of the original feeding apparatus 402, specular surface plate (unshown) or white pressing plate (unshown) is usable). Designated by 403, 404 are light sources, such as halogen lamps or a fluorescent lamps, for illuminating the original; 405, 406 are reflection shade for condensing the light from the light source 403, 404 onto the original. Designated by 307–309 are mirrors, and 410 is a lens for imaging the projection light or the reflected light from the original on the CCD401. Designated by 414 is a carriage accommodating the halogen lamps 403, 404, the reflection shades 405, 406 and the. mirror 407. Designated by 415 is a carriage for accommodating the mirrors 408, 409; and 413 is an interface (I/F) portion for another IPU or the like. The carriage 414 and carriage 415 are mechanically moved in a direction perpendicular to an electrical scanning (main-scanning) direction of the CCD101 at a speed V and speed V/2, respectively. By this, the whole surface of the original is scanned (sub-scan).

Then, a description will be provided as to the structure of the printer portion. Designated by 417 is a magenta (M) image formation station; 418 is a cyan (C) image formation station; 419 is a yellow (Y) image formation station; and 420 is a black (K) image formation station. Since the structures of them are the same, a description will be provided only as to the image formation station 417, and the description of the other is omitted for simplicity.

In the M image formation station 417, designated by 442 is a photosensitive drum. On the photosensitive drum 442, an electrostatic latent image is formed on the surface thereof by light for a LED recording head 210. Designated by 421 is a primary charger which charges the surface of the photosensitive drum 442 to a predetermined potential. Designated by 422 is a developing device which develops a latent image formed on the photosensitive drum 442 into a toner image. The developing device 422 includes a sleeve 445. The sleeve 445 is supplied with a developing bias. Designated by 423 is a transfer charger which effects discharge to the back side of the conveyor belt 433 to transfer the toner image from the photosensitive drum 442 onto the recording material carried on the conveyor belt 433. In the present embodiment, the transfer efficiency is so high that no cleaner portion is used. The cleaner portion may be used.

A disclosure will be provided as to the process of transferring the toner image onto the recording material, such as recording paper. The recording material stored in the cassette 440 or 441 is supplied to the conveyor belt 433 by a pick-up roller 439 or 438 and a feeding roller 436 or 437. The recording material thus supplied is charged by a charger 446. Designated by 448 is a conveyor belt roller to drive the conveyor belt 433. It cooperates with the charger 446 to electrically charge the recording material. By doing so, the recording material is attracted on the conveyer belt 433. The conveyer belt roller 448 may be in the form of a driving roller for driving the conveyer belt 433. A driving roller for driving the conveyer belt 433 may be provided on the opposite side.

Designated by 447 is an edge sensor to detect the leading edge of the recording material on the conveyer belt 433. The detection signal of the edge sensor 447 is fed to a color reader portion from the printer portion. It is used as a sub-scan synchronization signal when a video signal is fed from the color reader portion to the printer portion.

Thereafter, the recording material is fed by the conveyer belt 433. In the image formation station 417–420, the toner images are formed thereon in the order of magenta, cyna, yellow and black (MCYK). The recording material, having passed through the K image formation station 420, is electrically discharged by the charger 449 for the purpose of making easy the separation thereof from the conveyer belt 433, and then separated from the conveyer belt 433. Designated by 450 is a separation charger which is effective to prevent image disturbance attributable to separation discharge when the recording material is separated from the conveyer belt 433. The recording material thus separated is charged by the chargers 451, 452 for the purpose of preventing the image disturbance by increasing the attraction force of the toner, and then the toner image is heat-fixed by the fixing device 434. Thereafter, it is discharged to the tray 435.

Here, designated by X-1 to X-4 are process cartridges. Each of the process cartridges (X-1 to X-4) is provided with a connector for electric connection for an EEPROM, and a sensor for detecting a state of the developer in the developing device. The connector is shown in FIGS. 8–11.

Figure 10:
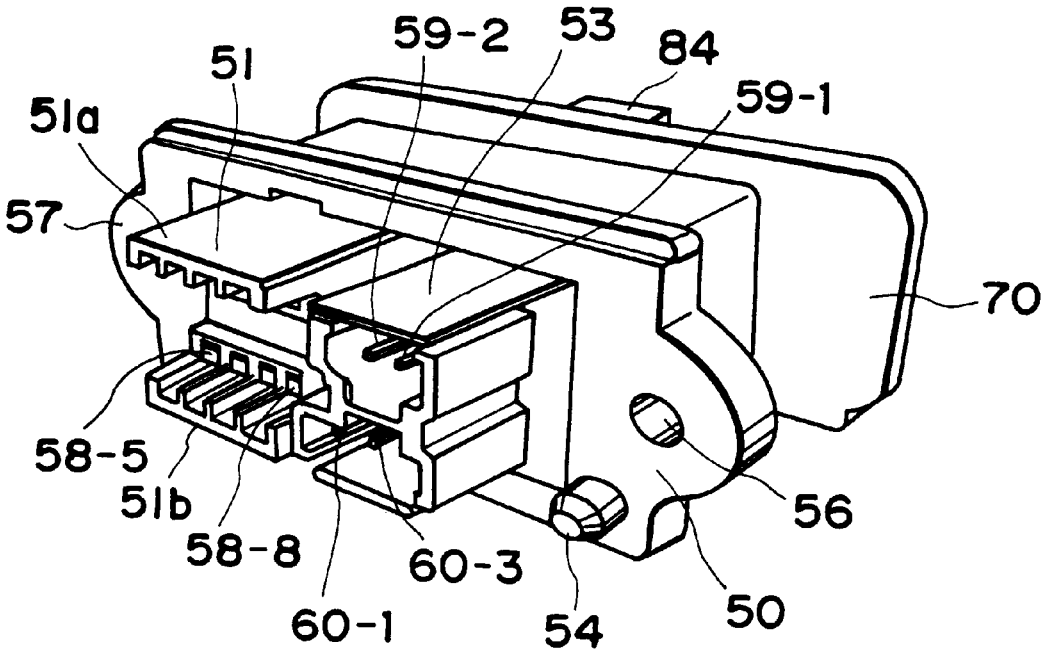
FIG. 10 is a perspective view as seen from the cartridge side connector when the connectors are connected.
Figure 11:
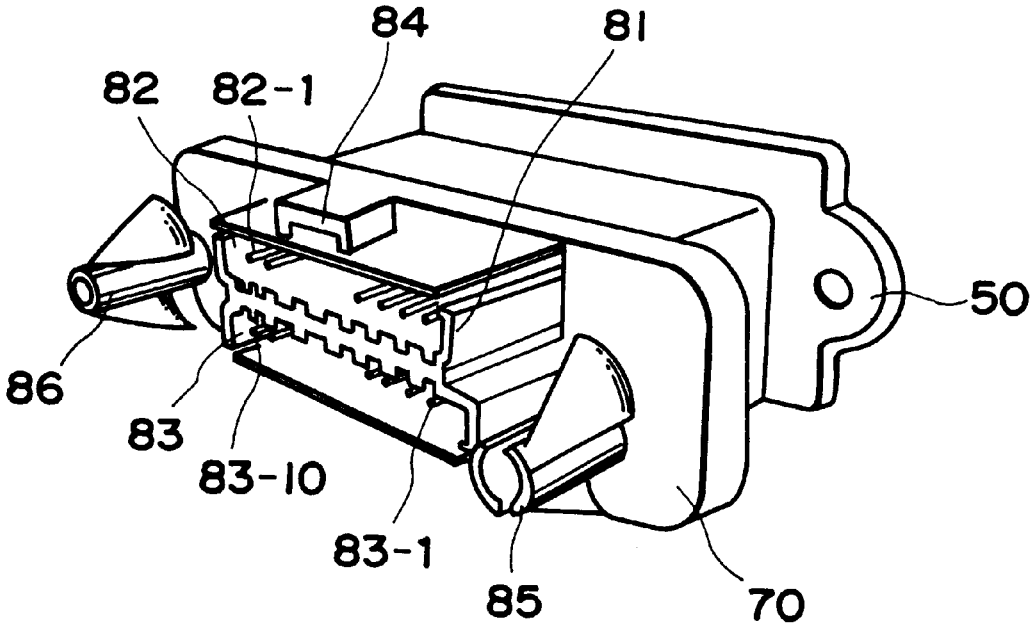
FIG. 11 is a perspective view as seen from the main assembly connector side, when the connectors are connected.

FIG. 10 and FIG. 11 are perspective views when the connector 50 and the connector 70 are engaged with each other.

As shown in FIG. 12, four process cartridges (X-1 to X-4) are juxtaposed. By them, a full-color image is formed.

Each of the process cartridge (X-1 to X-4) has a photosensitive drum 442, 443, 444 or 445. To charge the photosensitive drum 442–445, there is provided a charger 421, 424, 427 or 430. A developing device 445, 446, 447 or 448 is provided to develop the electrostatic latent image formed on the photosensitive drum. A voltage is applied to the charger and the developing device. To accomplish this, each of the process cartridges X-1 to X-4, is provided with a high voltage contact for the charging bias voltage and for the developing bias voltage. There are provided a driving means for rotating the photosensitive drum 442, 443, 444 or 445, driving means for driving the charger, the roller or the like. In the present embodiment, the EEPROM and the sensor are electrically connected with the main assembly of the apparatus by a single connector. By this, the process cartridge is downsized.

This is because, there is no need for providing the fixing means for respective connectors and spaces therefor. By using a single connector, the number of the fixing means can be reduced, and the spatial advantage results.

A description will be provided as to connector 50 mounted to the process cartridge (X-1 to X-4).

FIG. 8(*a*) is a view as seen from the IC ((memory) connection) side and from the side where the bundle of leads of the sensor are connected. FIG. 8(*b*) is a view of the connector 50 as seen from the left side. FIG. 8(*c*) is a view of the connector 50 as seen from the front side. FIG. 8(*d*) is a view as seen from the side where it is engaged with the main assembly side connector. In FIG. 8(*c*), 50-A, 50-B indicate the orientations of the connector. More particularly, 50-A indicates the IC side, and 50-B indicates the connector 70. Designated by 51 is a guide for mounting the IC52. When the IC52 is mounted, the IC52 is received by the guide 51 (in FIG. 8(*c*), the IC52 is mounted). The guide 51 has guide portions 51*a*, 51*b* which are opposed to each other. Designated by 53 is a connector housing for mounting a connector for connecting a sensor (unshown) provided in the process cartridge (X-1 to X-4). Designated by 54 is a regulating projection to determine a mounting direction when the connector 50 is mounted to the process cartridge. This will be described in detail hereinafter. Designated by 55 is a hole for fixing a cover (unshown) after the IC52 is mounted to the guide 51. Designated by 56, 57 are holes for fixing the connector 50 to the frame of the process cartridge (X-1 to X-4). The connector 50 is fixed to the cartridge frame by screws through the holes 56, 57. Designated by 58-1 to 58-8 are contacts for electrical connection of the IC52. Contacts 58-2, 58-3, 58-5, 58-6 are not shown in the figure. Designated by 59-1, 59-2, 60-2, 60-3 are electric contacts for electrical connection of the connector for connection of the sensor. Designated by 59-1 to 59-2 are two pin connectors. Designated by 60-1 to 60-3 are three pin connectors. 60-1 is in a non-contact state.

Designated by 61 is a mark indicating a mounting direction for mounting the IC52. In FIG. 8(*d*), designated by 62-1 to 62-8 are pins corresponding to the contacts 58-1 to 58-8 shown in FIG. 8(*a*). Contact 58-1 has the same structure as the pin 62-1. Similarly, the contact 58-2 and the contact 58-8 are the same as the pin 62-2 and the pin 62-8, respectively.

The pin 63-1, the pin 63-2, the pin 64-1 and the pin 64-2 correspond to the contact (pin)59-1, contact (pin)59-2, contact (pin)60-2 and the contact (pin)60-3, respectively. They are electrically conductive, respectively. Designated by 65-1, 65-2 are padded portions to assure connection between the connector 50 and the connector 70 in the correct directions.

FIG. 9 shows a main assembly side connector 70. FIG. 9(*a*) is a view of the connector 70 as seen from the side where the cable connector is engaged. FIG. 9(*b*) is a view of the connector 70 as seen from the front side; FIG. 9(*c*) is a view of the connector 70 as seen from the right side; FIG. 9(*d*) is a view as seen from the side where the connector 50 of the process cartridge is engaged.

In FIG. 9(*a*) designated by 8 is a housing for mounting the connectors 82, 83. Designated by 82 is a connector having a width corresponding to ten pins (82-1 to 82-10). The pin 82-1, 82-2, 82-7, 82-8, 82-9 and 82-10 are provided with connecting contacts. Pins 82-3 to 82-6 are in a non-conducted state. Designated by 23 is a connector having a width corresponding to 11 pins. Non-connection contacts are provided at the sides of pins 83-1 to 83-10 and 83-13. Pins 83-1, 83-2, 83-3, 83-4, 83-9 and 83-10 are provided with connecting contacts. The portions corresponding to the pins 83-5 to 83-8 are non-connecting contacts. Designated by 24 is a projected portion which functions to determine the mounting direction when the connector 70 is mounted to a mounting plate of the main assembly. This will be described in detail hereinafter.

Designated by 85, 86 are a mounting portion for fixing the connector 70 to the plate. In FIG. 9(*b*), 82-A, 82-B indicate orientations of the connector 70. Designated by 82-A is a cable connector side of the main assembly. Designated by 82-B is a connector 50 engaging side. In FIG. 9(*d*), designated by 87-1 to 87-8 are pins to which pins 62-1 to 62-8 of the connector 50 are in engagement and connected. The pin 88-1, the pin 88-2, the pin 88-3 and the pin 88-4 are connected to the pin 63-1, the pin 63-2, the pin 64-1 and the pin 64-2, respectively. In FIG. 9(*d*), 89-1, 89-2 indicates a beveled portion corresponding to the padded portion 65-1, 65-2 of the connector 50.

(Erroneous Mounting Prevention of Connector)

A description will be provided as to erroneous mounting prevention when the connector 50 is mounted to the process cartridge (X-1 to X-4).

Figure 13:
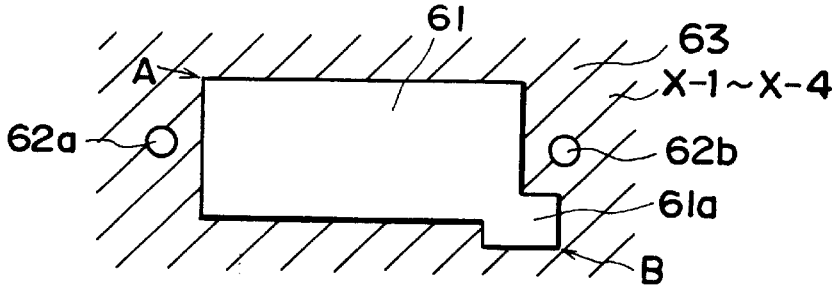
FIG. 13 is a top plan view of a connector mounting portion in the cartridge.

When the connector 50 of the present embodiment is mounted to the process cartridge (X-1 to X-4), the 50-A side of the connector 50 is mounted to the frame of the process cartridge. The portion 50-B of the connector 50 is engaged with the main assembly side connector 70. When the process cartridge is manufactured in a plant, the connector 50 has to be mounted to the process cartridge with the correct vertical direction and with the correct connecting direction. To assure this, the process cartridge, as shown in FIG. 13, is provided with mounting holes 61, 62*a*, 62*b*. The holes are for receiving the connector 50. Portions 62*a*, 62*b* are for fixing the screws or the like through the holes 56, 57 of the connector 50. The hole 61 has a rectangular section. The corner portion thereof is provided with a hole 61*a* having a rectangular section as indicated by an arrow B. Even if an attempt is made to mount the connector 50 to the hole 61*a* from the 50-B side, the attempt fails since the size of the projection 54 is too large to enter the hole 61. Therefore, mounting is prevented. When it is mounted to the opposite side, the projection 54 is positioned at a portion (FIG. 13) (arrow A). Therefore, the plate 63 and a projection 54 abut to each other. Thus, the connector 50 is prevented from engagement with the hole 61. When the connector 50 is mounted correctly into the hole 61, the projection 54 is aligned with the position of the arrow B (FIG. 13). Therefore, plate 63 does not interfere with the projection 54. Thus, the connector 50 is correctly mounted to the process cartridge X-1 to X-4.

A description will be provided as to the mounting of the connector 70 shown in FIG. 9 to the main assembly.

Figure 14:
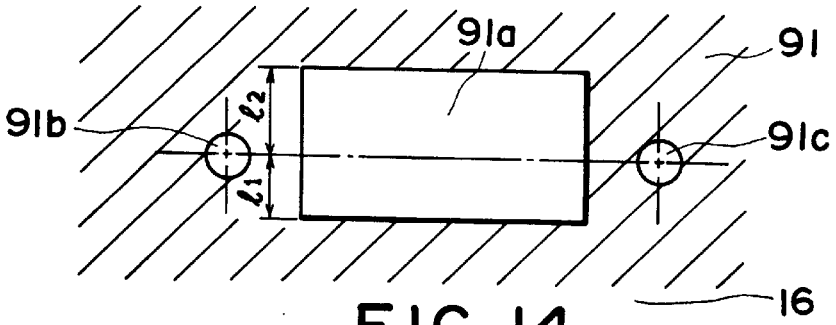
FIG. 14 is a top plan view of a connector mounting portion in the main assembly of the apparatus.

FIG. 14 is a top plan view of the mounting plate provided in the main assembly of the apparatus.

In the figure, the plate 91 is provided with a non-circular hole 91*a* and round holes 91*b*, 91*c*. To the plate 91, the 82-A side of the connector 70 (FIG. 9(*b*)) is mounted. The 82-B side of the connector 70 is engaged with the 50-B side (FIG. 8(*c*)) of the connector 50. The connector 70 is provided with the projection 84 described hereinbefore to prevent erroneous mounting when the connector 70 is mounted to the plate 91. Therefore, the connector 70 is asymmetrical about the center of the mounting members 85, 86. Therefore, as shown in FIG. 14, the distances $l_1$ and $l_2$ of the mounting members 85, 86 are different. The projection 84 is on the side having the distance $l_2$. With such a structure, the erroneous mounting of the connector 70 can be effectively prevented. This is because mounting is impossible since there is no means of fixing at the 82-B side. On the other hand, if an attempt is made to mount the 82-A with incorrect vertical orientation, the projection 84 is at the distance $l_1$ side. Then, the plate 91 and the projection 84 interfere with each other. Therefore, the connector 70 is prevented from mounting to the plate 91. Thus, the connector 70 is mountable to the plate 91 only when the direction and orientation thereof are correct.

The non-circular hole 91*a* receives the connector 70. To the round holes 91*b*, 91*b*, the mounting portion 85–86 is fixed.

(Prevention of Erroneous Engagement of Connector)

A description will be provided as to erroneous mounting prevention in the connector 50 and the connector 70.

The connector 50 and connector 70 are not connected unless the vertical directions are correct.

Figure 15:
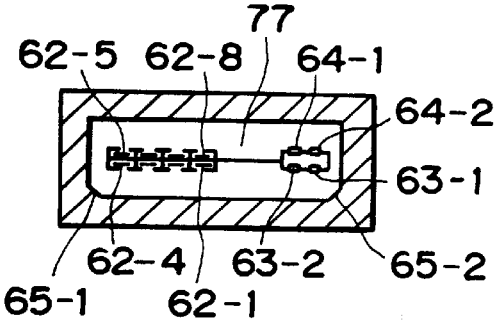
FIG. 15 is a top plan view of a connector engaging portion of the cartridge.
Figure 16:
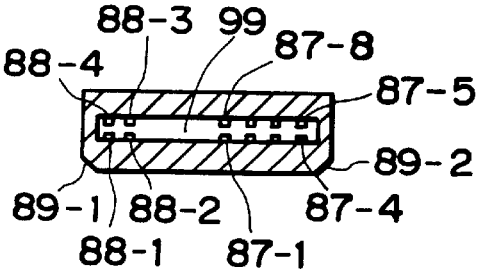
FIG. 16 is a top plan view of a connector engaging portion of the main assembly.

The corner portions 77*a*, 77*b* of the engaging portion 77 of the connector 50 are provided with the padded portions 65-1, 65-2 as described hereinbefore. The padded portions 65-1, 65-2 are inclined at the mount engageable with the connector 70. Therefore, the opening of the engaging portion 77 has a shape of non-hatched portion in FIG. 15. As shown in FIG. 15, the bottom corner portions are inclined. These are padded portions. On the other hand, the connector 70 has corresponding beveled portions 89-1, 89-2 in the engaging portion 99. FIG. 16 shows them. As will be understood from this figure, the bottom corners are cut (89-1, 89-2). Therefore, even if an attempt is made to engage the engaging portion 77 and the engaging portion 99 with the wrong vertical orientation, the padded portions shown in FIG. 15 interfere so that they cannot be engaged.

Thus, the erroneous mounting can be prevented.

The pitch will be described.

To the connector 50, the IC (memory) 52 having a pitch of 2.54 mm is connectable, and a connector of 2 mm pitch is connectable.

Normally, DIP IC 52 has a pitch of 2.54 mm. The connector 50 is constituted such that pins 52-1 to 52-8 (unshown) of the IC 52 are connected to the pins 58-1 to 58-8 shown in FIG. 8. Therefore, the connecting portions 62-1 to 62-4 and 62-5 to 62-8 connectable with the connector 70 are arranged at the pitch of 2.54 mm. On the other hand, to the engaging portions 59-1 to 59-2, an engaging portion for connecting the sensor of two pin type is engaged.

To the engaging portions 10-1 to 10-3, a three pin type engaging portion is engaged. In the present embodiment, four lead lines are required by the sensor. Therefore, pin 10-1 (first pin of the three pins) is not provided with a connecting pin. However, the number of pins is not limited, and the number can be increased.

Figure 17:
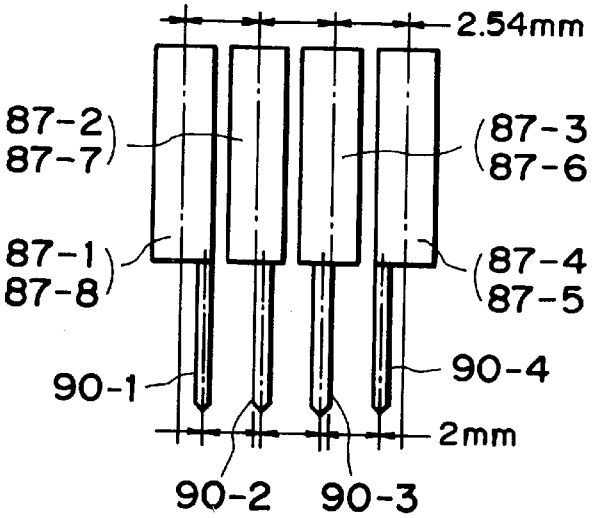
FIG. 17 is a front view of a connector wherein the pitch of contacts is changed.

Therefore, the pitch of the sensor side is 2 mm. The engaging portion with the connector 70 has a pitch of 2 mm. It corresponds to the pins 63-1, 63-2, 64-1, 64-2, and pin 63-1 and 63-2 are arranged at the pitch of 2 mm, and the 64-1 and the 64-2 are arranged at the pitch of 2 mm. By doing so, the contact used in the connector 50 side has a simple straight structure without complication. This is effective to reduce the cost. The contacts of the connector 70 shown in FIG. 9, connectable with the connector 50, are contacts 27-1 to 27-4 and 27-5 to 27-8 at the IC side. The contacts 27-1 to 27-4 are arranged at a 2.54 mm pitch, and the contact 27-5 to 27-8 are arranged also at a 2.54 mm pitch. The sensor side contacts are the contacts designated by 28-1 to 28-4. The contacts 28-1 and 28-2 and the contacts 283 and 28-4 are disposed at 2 mm pitch. In order to transmit the electric signal to the connector 70, the 10 pin connector with a 2 mm pitch and the 11 pin connector with a 2 mm pitch are connectable to the portion indicated by a reference numeral 81 in FIG. 9(*a*). From the standpoint of cost reduction, an integral connector is desirable. The integral structure is preferable in view of a harness manufacturing step or the like. The integral structure permits simplification of the cable manufacturing step or the like. In view of this, the contacts having a 2.54 mm pitch at the IC side is constituted as shown in FIG. 17. By this, a 2 mm pitch arrangement is accomplished.

More particularly, FIG. 17 is an enlarged schematic view of the contacts 87-1 to 87-8 of the connector 70. In FIG. 17, the top side is engageable with the connector 50. The bottom side thereof is connectable with a connector having the contacts arranged at a 2 mm pitch. In the top side connecting portion for the connector 50, the contacts are arranged at a 2.54 mm pitch. Using the widths of the contacts to the advantage, the pitch is changed to 2 mm. The connecting contacts are extended from contacts 87-2(87-7) and 87-3 (87-6) with the contacts 87-2 (87-7) and contacts 87-3 (87-6) are at the center so that the pitch is 2 mm. They are indicated as extended portions 90-2, 90-3 in FIG. 17.

The extended portion 90-1 is extended from the contact 87-2 with a pitch of 2 mm from the extended portion 90-2. The extended portion 90-4 is extended from the contact 87-4 with a pitch of 2 mm from the extended portion 90-3. With the structure, the 2.54 mm pitch at the IC can be converted to 2 mm. with respect to the contacts 88-1 to 88-4 at the sensor side, the pitches between the contacts 88-2 and 87-1 and the pitch between the contacts 88-3 and 87-8, are 2n (n is an integer). Even if the contacts 28-2 and 27-1 are spaced or the contacts 28-3 and 27-8 are spaced, it is of no problem if pins are arranged at 2 mm pitch.

Here, 2 mm pitch connectors are widely used and therefore are easily available. Normally, at the connector 70 side, four connectors are necessary, namely, two for the IC (for 22-6 to 22-10 and 23-2 to 23-5) and two for the sensor (for 23-9 to 23-10 and 22-1 and 22-2). Additionally, an exclusive connector is required at the IC side. This increases the cost, and the required space is large. According to the embodiments of the present invention, however, all connections are accomplished by two sets of connectors.

Therefore, the signal from the IC is taken by two connectors 2. However, the electric signals are both capable of being processed by a processing control substrate. Therefore, the integral structure is usable.

In the present embodiment, the connector 50 is provided with a taper 76 to accept the connector 70. As shown in FIG. 8, the taper 76 is provided at the hatched portion.

According to the embodiments, an inexpensive and small-sized connector provided with an electronic device such as an EEPROM or another IC, can be provided. According to the above-described embodiment, there is provide a connector which can accomplish, with an additional part, a discrimination as to whether a unit or process cartridge, which is detachably mountable to a main assembly of the apparatus, is mounted or not. Additionally, there is provided a connector unit, a process cartridge and an electrophotographic image forming apparatus wherein the connector is connectable with a sensor or a driving source if necessary without increasing the space required for the space, in addition to the EEPROM. According to the embodiment, the IC is connected directly to the unit or process cartridge side connector. Additionally, the element or elements, such as a sensor or load for the process cartridge, which are operated through electronic leads, can be connected through the same connector. By this, the connection between the IC and the other electronic part is accomplished. Therefore, the unit and the process cartridge are downsized.

As described in the foregoing, a connector provided with the memory can provided.

According to the present invention, a connector, which is connectable with an electrical part in addition to the memory, can be provided.

According to the present invention, there is provided a unit, process cartridge and an electrophotographic image forming apparatus to which a unit or a process cartridge is detachably mountable.

While the invention has been described with reference to the structures disclosed herein, it is not confined to the details set forth and this application is intended to cover such modifications or changes as may come within the purposes of the improvements or the scope or the following claims.

What is claimed is:

1. A unit connector for a unit detachably mountable to a main assembly of an electrophotographic image forming apparatus, for electrical connection with a main assembly connector provided in the main assembly of the electrophotographic image forming apparatus, said unit connector comprising:

a first regulating portion for preventing said unit connector from engaging with the main assembly connector in an erroneous direction;

a second regulating portion for preventing said unit connector from being mounted in an erroneous direction;

a memory for storing information;

a memory connecting portion for electrical connection with said memory to establish an electrical connection between said memory and the main assembly of the electrophotographic image forming apparatus when said unit is mounted to the main assembly of an electrophotographic image forming apparatus, wherein said memory connecting portion has electrical connection contacts arranged at a first interval;

an electrical part connecting portion for electrical connection with an electrical part provided in said unit to establish an electrical connection between the electrical part and the main assembly of the apparatus when said unit is mounted to the main assembly of the apparatus and wherein said electrical part connecting portion has electrical connection contacts arranged at a second interval, wherein the first and second intervals are different; and a connector connecting portion for electrical connection between said unit connector and the main assembly connector when said unit is mounted to the main assembly of the apparatus, wherein the electric connection between the main assembly connector and said unit connector enables the transmission of data stored in the memory and information of the electrical part to the main assembly of the apparatus, and wherein said connector connecting portion has electrical connection contacts which are arranged at the second interval.

2. A unit connector according to claim 1, wherein said memory connecting portion and said electrical part connecting portion are juxtaposed with each other, and said connector connecting portion is disposed on an opposite side in a direction of connection to the main assembly connector of said apparatus.

3. A unit connector according to claim 1, wherein said second regulating portion is in the form of a projection.

4. A unit connector according to claim 1, wherein said connector connecting portion is enclosed with a unit connector frame, and when said unit connector is connected to the main assembly connector, a main assembly connector frame enters the unit connector frame.

5. A unit connector according to claim 1, wherein said electrical part is a sensor.

6. A unit connector according to claim 5, wherein said sensor functions to detect a state of a developer in a developing device.

7. A unit connector according to claim 6, wherein the unit to which said unit connector is mounted is a process cartridge, wherein said process cartridge contains an electrophotographic photosensitive member and process means actable on the electrophotographic photosensitive member.

8. A unit connector for a unit detachably mountable to a main assembly of an electrophotographic image forming apparatus, for electrical connection with a main assembly connector provided in the main assembly of the electrophotographic image forming apparatus, said unit connector comprising:

a memory for storing information;

a memory connecting portion for electrical connection with said memory to establish an electrical connection between said memory and the main assembly of the electrophotographic image forming apparatus when said unit is mounted to the main assembly of an electrophotographic image forming apparatus;

an electrical part connecting portion for electrical connection with an electrical part provided in said unit to establish an electrical connection between the electrical part and the main assembly of the apparatus when said unit is mounted to the main assembly of the apparatus; and a connector connecting portion for electrical connection between said unit connector and the main assembly connector when said unit is mounted to the main assembly of the apparatus, wherein the electric connection between the main assembly connector and said unit connector enables the transmission of data stored in the memory and information of the electrical part to the main assembly of the apparatus, wherein said memory connecting portion has electrical connection contacts arranged at a first interval, and said electrical part connecting portion has electrical connection contacts arranged at a second interval, wherein the first and second intervals are different wherein the first interval is approximately 2.54 mm, and the second interval is approximately 2.00 mm.

9. A process cartridge detachably mountable to a main assembly of an electrophotographic image forming apparatus, wherein the main assembly includes a main assembly connector, said process cartridge comprising:

(a) an electrophotographic photosensitive member;

(b) process means actable on said electrophotographic photosensitive member; and (c) a unit connector electrically connectable with the main assembly connector, said unit connector including:

a first regulating portion for preventing said unit connector from engaging with the main assembly connector in an erroneous direction;

a second regulating portion for preventing said unit connector from being mounted in an erroneous direction;

a memory for storing information;

a memory connecting portion for electrical connection with said memory to establish an electrical connection between said memory and the main assembly of the electrophotographic image forming apparatus when said process cartridge is mounted to the main assembly of the electrophotographic image forming apparatus, wherein said memory connecting portion has electrical connection contacts arranged at a first interval;

an electrical part connecting portion for electrical connection with an electrical part provided in said process cartridge to establish an electrical connection between the electrical part and the main assembly of the apparatus when said process cartridge is mounted to the main assembly of the apparatus, and wherein said electrical part connecting portion has electrical connection contacts arranged at a second interval, wherein the first and second intervals are different; and a connector connecting portion for electrical connection between said unit connector and the main assembly connector when said process cartridge is mounted to the main assembly of the apparatus, wherein the electric connection between the main assembly connector and said unit connector enables the transmission of data stored in the memory and information of the electrical part to the main assembly of the apparatus, and wherein said connector connecting portion has electrical connection contacts which are arranged at the second interval.

10. A process cartridge according to claim 9, wherein said memory connecting portion and said electrical part connecting portion are juxtaposed with each other, and said connector connecting portion is disposed on an opposite side in a direction of connection to the main assembly connector of said apparatus.

11. A process cartridge according to claim 9, wherein said second regulating means is in the form of a projection.

12. A process cartridge according to claim 9, wherein said connector connecting portion is enclosed with a unit connector frame, and when said unit connector is connected to the main assembly connector, a main assembly connector frame enters the unit connector frame.

13. A process cartridge according to claim 9, wherein said electrical part is a sensor.

14. A process cartridge according to claim 13, wherein said sensor functions to detect a state of a developer in a developing device.

15. A process cartridge according to claim 9, wherein said process means comprises at least one of a charging member for electrically charging said electrophotographic photosensitive member; a developing member for developing an electrostatic latent image formed on said electrophotographic photosensitive member; and a cleaning member for removing a developer remaining on said electrophotographic photosensitive member.

16. A process cartridge, detachably mountable to a main assembly of an electrophotographic image forming apparatus, wherein the main assembly includes a main assembly connector, said process cartridge comprising:

(a) an electrophotographic photosensitive member;

(b) process means actable on said electrophotographic photosensitive member; and (c) a unit connector electrically connectable with the main assembly connector, said unit connector including:

a memory for storing information;

a memory connecting portion for electrical connection with said memory to establish an electrical connection between said memory and the main assembly of the electrophotographic image forming apparatus when said process cartridge is mounted to the main assembly of the electrophotographic image forming apparatus;

an electrical part connecting portion for electrical connection with an electrical part provided in said process cartridge to establish an electrical connection between the electrical part and the main assembly of the apparatus when said process cartridge is mounted to the main assembly of the apparatus; and a connector connecting portion for electrical connection between said unit connector and the main assembly connector when said process cartridge is mounted to the main assembly of the apparatus, wherein the electric connection between the main assembly connector and said unit connector enables the transmission of data stored in the memory and information of the electrical part to the main assembly of the apparatus, wherein said memory connecting portion has electrical connection contacts arranged at a first interval, and said electrical part connecting portion has electrical connection contacts arranged at a second interval, wherein the first and second intervals are different, wherein the first interval is approximately 2.54 mm, and the second interval is approximately 2.00 mm.

17. An electrophotographic image forming apparatus for forming an image on a recording material, wherein a process cartridge is detachably mountable to said electrophotographic image forming apparatus, said electrophotographic image forming apparatus comprising:

(a) a main assembly connector provided in a main assembly of said apparatus; and (b) a mounting portion for detachably mounting a process cartridge, said process cartridge including:

an electrophotographic photosensitive member;

process means actable on said electrophotographic photosensitive member; and a unit connector electrically connectable with the main assembly connector, said unit connector including:

a first regulating portion for preventing said unit connector from engaging with the main assembly connector in an erroneous direction;

a second regulating portion for preventing said unit connector from being mounted in an erroneous direction;

a memory for storing information:

a memory connecting portion for electrical connection with said memory to establish an electrical connection between said memory and the main assembly of the electrophotographic image forming apparatus when said process cartridge is mounted to the main assembly of an electrophotographic image forming apparatus, wherein said memory connecting portion has electrical connection contacts arranged at a first interval;

an electrical part connecting portion for electrical connection with an electrical part provided in said process cartridge to establish an electrical connection between the electrical part and the main assembly of the apparatus when said process cartridge is mounted to the main assembly of the apparatus, and wherein said electrical part connecting portion has electrical connection contacts arranged at a second interval, wherein the first and second intervals are different; and a connector connecting portion for electrical connection between said unit connector and the main assembly connector when said process cartridge is mounted to the main assembly of the apparatus, wherein the electric connection between the main assembly connector, and said unit connector enables the transmission of data stored in the memory and information of the electrical part to the main assembly of the apparatus, and wherein said connector connecting portion has electrical connection contacts which are arranged at the second interval.

18. An image forming apparatus according to claim 17, wherein said electrophotographic image forming apparatus is a full-color copying machine, and wherein said process cartridge is a process cartridge accommodating a yellow developer, a process cartridge accommodating a magenta developer; a process cartridge accommodating a cyan developer or a process cartridge accommodating a black developer, and wherein said four process cartridges are mountable to said mounting portion at the same time.

19. An image forming apparatus according to claim 18, wherein said mounting portion mounts said four process cartridges in a horizontal plane.

20. A unit detachably mountable to a main assembly of an electrophotographic image forming apparatus, wherein the main assembly of the apparatus includes a main assembly connector, said unit comprising:

a unit connector electrically connectable with the main assembly connector, said unit connector including:

a first regulating portion for preventing said unit connector from engaging with the main assembly connector in an erroneous direction;

a second regulating portion for preventing said unit connector form being mounted in an erroneous direction;

a memory for storing information;

a memory connecting portion for electrical connection with said memory to establish an electrical connection between said memory and the main assembly of the electrophotographic image forming apparatus when said unit is mounted to the main assembly of an electrophotographic image forming apparatus, wherein said memory connecting portion has electrical connection contacts arranged at a first interval;

an electrical part connecting portion for electrical connection with an electrical part provided in said unit to establish an electrical connection between the electrical part and the main assembly of the apparatus when said unit is mounted to the main assembly of the apparatus, and wherein said electrical part connecting portion has electrical connection contacts arranged at a second interval, wherein the first and second intervals are different; and a connector connecting portion for electrical connection between said unit connector and the main assembly connector when said process cartridge is mounted to the main assembly of the apparatus, wherein the electrical connection between the main assembly connector and said unit connector enables the transmission of data stored in the memory and information of the electrical part to the main assembly of the apparatus, and wherein said connector connecting portion has electrical connection contacts which are arranged at the second interval.

21. A unit according to claim 20, wherein said memory connecting portion and said electrical part connecting portion are juxtaposed with each other, and said connector connecting portion is disposed on an opposite side in a direction of connection to the main assembly connector of said apparatus.

22. A unit according to claim 20, wherein said second regulating portion is in the form of a projection.

23. A unit according to claim 20, wherein said connector connecting portion is enclosed with a unit connector frame, and when said unit connector is connected to the main assembly connector, a main assembly connector frame enters the unit connector frame.

24. A unit according to claim 20, wherein said electrical part is a sensor.

25. A unit according to claim 24, wherein said sensor functions to detect a state of a developer in a developing device.

26. A unit according to claim 20, wherein the unit to which said unit connector is mounted is a process cartridge, wherein said process cartridge contains an electrophotographic photosensitive member and process means actable on the electrophotographic photosensitive member.

27. A unit according to claim 20, wherein said unit is a developing cartridge, a fixing unit or an intermediary transfer unit detachably mountable to a main assembly of the electrophotographic image forming apparatus.

28. A unit, detachably mountable to a main assembly of an electrophotographic image forming apparatus, wherein the main assembly of the apparatus includes a main assembly connector, said unit comprising:

a unit connector electrically connectable with the main assembly connector, said unit connector including:

a memory for storing information;

a memory connecting portion for electrical connection with said memory to establish an electrical connection between said memory and the main assembly of the electrophotographic image forming apparatus when said unit is mounted to the main assembly of an electrophotographic image forming apparatus;

an electrical part connecting portion for electrical connection with an electrical part provided in said unit to establish an electrical connection between the electrical part and the main assembly of the apparatus when said unit is mounted to the main assembly of the apparatus; and a connector connecting portion for electrical connection between said unit connector and the main assembly connector when said process cartridge is mounted to the main assembly of the apparatus, wherein the electrical connection between the main assembly connector and said unit connector enables the transmission of data stored in the memory and information of the electrical part to the main assembly of the apparatus, and wherein said connector connecting portion has electrical connection contacts which are arranged at the second interval, wherein said memory connecting portion has electrical connection contacts arranged at a first interval, and said electrical part connecting portion has electrical connection contacts arranged at a second interval, wherein the first and second intervals are different wherein the first interval is approximately 2.54 mm, and the second interval is approximately 2.00 mm.

* * * * *

UNITED STATES PATENT AND TRADEMARK OFFICE

CERTIFICATE OF CORRECTION

PATENT NO. : 6,349,182 B2
DATED : February 19, 2002
INVENTOR(S) : Toshihiko Otsubo et al.

It is certified that error appears in the above-identified patent and that said Letters Patent is hereby corrected as shown below:

Column 2,
Line 31, “elecctrophotograpic” should read -- electrophotographic --.

Column 3,
Line 26, “fall-color” should read -- full-color --.

Column 4,
Line 42, “of the connectors” (2nd occurrence) should be deleted.
Line 56, “210” should read -- 201 --.

Column 5,
Line 3, “shown” should read -- show --.
Line 56, “from” should read -- frame --.

Column 6,
Line 47, “shows” should read -- show --.
Line 58, “or a” should read -- or --.

Column 7,
Line 51, “cyna” should read -- cyan --.

Column 8,
Line 9, “cartridge” should read -- cartridges --.

Column 11,
Line 19, “283” should read -- 28-3 --.
Line 29, “is” should read -- are --.

Column 12,
Line 7, “provide” should read -- provided --.
Line 24, “can” should read -- can be --.
Line 36, “scope or” should read -- scope of --.

Column 13,
Line 4, “electric” should read -- electrical --.

UNITED STATES PATENT AND TRADEMARK OFFICE

CERTIFICATE OF CORRECTION

PATENT NO. : 6,349,182 B2
DATED : February 19, 2002
INVENTOR(S) : Toshihiko Otsubo et al.

It is certified that error appears in the above-identified patent and that said Letters Patent is hereby corrected as shown below:

Column 16,
Line 52, “form” should read -- from --.

Signed and Sealed this

Eighth Day of October, 2002

*Attest:*

*Attesting Officer*

JAMES E. ROGAN
*Director of the United States Patent and Trademark Office*